US005882586A

United States Patent [19]

Tamura et al.

[11] Patent Number: 5,882,586

[45] Date of Patent: Mar. 16, 1999

[54] HEAT-RESISTANT NICKEL-BASED ALLOY EXCELLENT IN WELDABILITY

[75] Inventors: Itaru Tamura, Yokohama; Kazunori Tokoro, Tokyo; Takashi Kawabata; Tsuyoki Kokubun, both of Utsunomiya; Toshio Mochizuki, Kawasaki; Shuichi Sakashita, Utsunomiya; Hisataka Kawai, Takasago; Ikuo Okada, Takasago; Ichiro Tsuji, Takasago; Kouji Takahashi, Takasago; Taiji Torigoe, Takasago, all of Japan

[73] Assignees: Mitsubishi Steel Mfg. Co., Ltd.; Mitsubishi Jukogyo Kabushiki Kaisha, both of Tokyo, Japan

[21] Appl. No.: 899,587

[22] Filed: Jul. 24, 1997

Related U.S. Application Data

[63] Continuation-in-part of Ser. No. 726,213, Oct. 4, 1996, abandoned, which is a continuation of Ser. No. 417,990, Apr. 6, 1995, abandoned.

[30] Foreign Application Priority Data

Oct. 31, 1994 [JP] Japan ..... 6-267111

[51] Int. Cl.[6] ..... C22C 19/05

[52] U.S. Cl. ..... 148/410; 148/428; 148/419; 148/442; 420/448

[58] Field of Search ..... 148/410, 428, 148/419, 442; 420/448

[56] References Cited

U.S. PATENT DOCUMENTS

| | | | |
|---|---|---|---|
| 4,039,330 | 8/1977 | Shaw . | |
| 4,769,087 | 9/1988 | Genereux et al. . | |
| 4,810,467 | 3/1989 | Wood et al. | 420/448 |
| 5,131,961 | 7/1992 | Sato et al. | 148/677 |
| 5,370,497 | 12/1994 | Doi et al. | 415/199 |

FOREIGN PATENT DOCUMENTS

| | | |
|---|---|---|
| 0 302 302 | 2/1989 | European Pat. Off. . |
| 0 361 524 | 4/1990 | European Pat. Off. . |
| 0 561 179 | 9/1993 | European Pat. Off. . |
| 5-125471 | 5/1993 | Japan . |
| 1 367 661 | 9/1974 | United Kingdom . |

OTHER PUBLICATIONS

Advanced Materials & Processes Apr. 1992, "Advanced Materials Propel Progress in Land–Based Gas Turbines", P.W. Schilke et al, pp. 22–30.

Welding Research Supplement, "Improving the Weldability of Ni–Base Superalloy 713C", A. Koren et al, Nov. 1982, pp. 348–s–351–ss.

Welding Journal, "A New Approach to the Weldability of Nickel–Base As–Cast and Powder Metallurgy Superalloys", M.H. Haafkens et al, Nov. 1982, pp. 25–30.

*Primary Examiner*—Margery Phipps

*Attorney, Agent, or Firm*—Flynn, Thiel, Boutell & Tanis, P.C.

[57] ABSTRACT

A heat-resistant nickel-based alloy having excellent welding properties, said nickel-based alloy consisting essentially of, in terms of wt. %, 0.05 to 0.25% of C, 18 to 25% of Cr, 15 to 25% of Co, at least one selected from the group consisting of up to 3.5% of Mo and 5 to 10% of W, with W+½Mo being 5 to 10%, 1.0 to 5.0% of Ti, 1.0 to 4.0% of Al, 0.5 to 4.5% of Ta, 0.2 to 3.0% of Nb, 0.005 to 0.10% of Zr, 0.001 to 0.01% of B and the balance being Ni and unavoidable impurities, wherein the (Al+Ti) content and the (W+½Mo) content are within the range surrounded by the lines connecting points A (Al+Ti: 5%, W+½Mo: 10%), B (Al+Ti: 5%, W+½Mo: 5%), C (Al+Ti: 7%, W+½Mo: 5%), and D (Al+Ti: 7%, W+½Mo: 10%) excluding the line A-B in FIG. 1. Another alloy has substantially the same composition as described above except that the Cr content is 10 to 20% and the (Al+Ti) content and the (W+½Mo) content are within the range surrounded by the lines connecting points A, B, E (Al+Ti: 4%, W+½Mo: 5%), F (Al+Ti: 4%, W+½Mo: 0.5%), G (Al+Ti: 7%, W+½Mo: 0.5%) and D, excluding the line A-B-E, in FIG. 1.

8 Claims, 8 Drawing Sheets

PLAIN VIEW

SIDE VIEW

HEAT-RESISTANT NICKEL-BASED ALLOY EXCELLENT IN WELDABILITY

CROSS REFERENCE TO RELATED APPLICATION

The present application is a continuation-in-part of U.S. Ser. No. 08/726 213, filed Oct. 4, 1996, now abandoned, which was a continuation of U.S. Ser. No. 08/417 990, filed Apr. 6, 1995 and now abandoned.

BACKGROUND OF THE INVENTION

1. Field of the Invention

The present invention relates to a heat-resistant nickel-based alloy that can be used as a material for forming the stationary turbine vane of a gas turbine and other parts to be exposed to high temperatures.

2. Description of the Prior Art

Heat-resistant alloys used as materials for parts to be exposed to high temperatures, such as the stationary turbine vane of a gas turbine, include an Ni-based alloy which enjoys the effects of both strengthening through precipitation of an intermetallic compound $Ni_3(Al,Ti)$, i.e., a γ' phase, and strengthening through solid solution with Mo, W, etc., and a Co-based alloy strengthened through precipitation of a carbide.

In the Ni-based alloy, an increase in the amount of precipitation of the γ' phase generally tends to lower the weldability of the alloy, though it improves the high-temperature strength of the alloy. For example, this is clear from the fact that an alloy increased in the amount of precipitation of the γ' phase to improve the high-temperature strength thereof (Japanese Patent Publication No. 6,968/1979) is very poor in weldability, while an alloy decreased in the amount of precipitation of the γ' phase to improve the weldability thereof (Japanese Patent Laid-Open No. 104,738/1989) is very low in high-temperature strength. On the other hand, the Co-based alloy, though generally good in weldability, is low in high-temperature strength and no remarkable improvement can be expected.

As is apparent from the foregoing, since the high-temperature strength of the Co-based alloy is limited, the Ni-based alloy must be improved in weldability without detriment to the high-temperature strength thereof.

SUMMARY OF THE INVENTION

In order to improve the weldability of the Ni-based alloy without detriment to the high-temperature strength thereof, the content of the γ' phase-forming elements such as Al and Ti should not be lowered, but the content of other elements such as W, C, and Zr must be adjusted for the desired purpose of obtaining an alloy which can be used to produce, for example, welded structures to be used at high temperatures, such as the stationary vane of a gas turbine and apparatuses having a welded structure. The performance of such an alloy is characterized by a creep rupture life of at least 110 hours as measured under 20 kgf/mm$^2$ at 900° C., a maximum crack length of at most 0.8 mm, as measured using 5×60×100 mm test pieces TIG-welded to each other under welding conditions involving a welding current of 100 A, a welding voltage of 12 V and a welding speed of 1.67 mm/sec, according to a varestraint test wherein the added strain (total strain) is 0.25% or 0.77%.

As a result of intensive investigations, the inventors of the present invention have found out that an alloy having an excellent high-temperature strength and a good weldability can be obtained by increasing its high-temperature strength through the addition of Cr and Co within such respective ranges of content as not to form deleterious phases such as a α phase and a μ phase and by the further addition of γ' phase-forming elements such as Al, Ti, Nb and Ta as well as solid solution strengthening elements, such as W and Mo, while at the same time improving the weldability through the addition of suitable amounts of C, Zr and B, which are liable to segregate in grain boundaries, as corresponds to an alloy composition which will be described later; and that a Ni-based alloy usable as a material for parts to be exposed to high temperatures and used in a low-grade fuel such as heavy oil, i.e., having an excellent oxidation resistance and corrosion resistance as well, can be prepared. The present invention has been completed based on these findings.

Specifically, in accordance with the present invention, there are provided:

(1) a heat-resistant nickel-based alloy having excellent welding properties,. said nickel-based alloy consisting essentially of, in terms of wt. %, 0.05 to 0.25% of C, 18 to 25% of Cr, 15 to 25% of Co, at least one selected from the group consisting of up to 3.5% of Mo and 5 to 10% of W, with W+½Mo being 5 to 10%, 1.0 to 5.0% of Ti, 1.0 to 4.0% of Al, 0.5 to 4.5% of Ta, 0.2 to 3.0% of Nb, 0.005 to 0.10% of Zr, 0.001 to 0.01% of B,and the balance being Ni and unavoidable impurities, wherein the (Al+Ti) content and the (W+½Mo) content are within the range surrounded by the lines connecting point A (Al+Ti: 5%, W+½Mo: 10%), point B (Al+Ti: 5%, W+½Mo: 5%), point C (Al+Ti: 7%, W+½Mo: 5%), and point D (Al+Ti: 7%, W+½Mo: 10%) excluding the line A-B in FIG. 1.

(2) a heat-resistant nickel-based alloy having excellent welding properties, said nickel-based alloy consisting essentially of, in terms of wt. %, 0.05 to 0.25% of C, 10 to 20% of Cr, 15 to 25% of Co, at least one selected from the group consisting of up to 3.5% of Mo and 0.5 to 10% of W, with W+½Mo being 0.5 to 10%, 1.0 to 5.0% of Ti, 1.0 to 4.0% of Al, 0.5 to 4.5% of Ta, 0.2 to 3.0% of Nb, 0.005 to 0.10% of Zr, 0.001 to 0.01% of B,and the balance being Ni and unavoidable impurities, wherein the (Al+Ti) content and the (W+½Mo) content are within the range surrounded by the lines connecting point A (Al+Ti: 5%, W+½Mo: 10%), point B (Al+Ti: 5%, W+½Mo: 5%), point E (Al+Ti: 4%, W+½Mo: 5%), point F (Al+Ti: 4%, W+½Mo: 0.5%), point G (Al+Ti: 7%, W+½Mo: 0.5%), and point D (Al+Ti: 7%, W+½Mo: 10%) excluding the line A-B-E in FIG. 1.

DETAILED DESCRIPTION OF THE PREFERRED EMBODIMENTS

Figure 1:
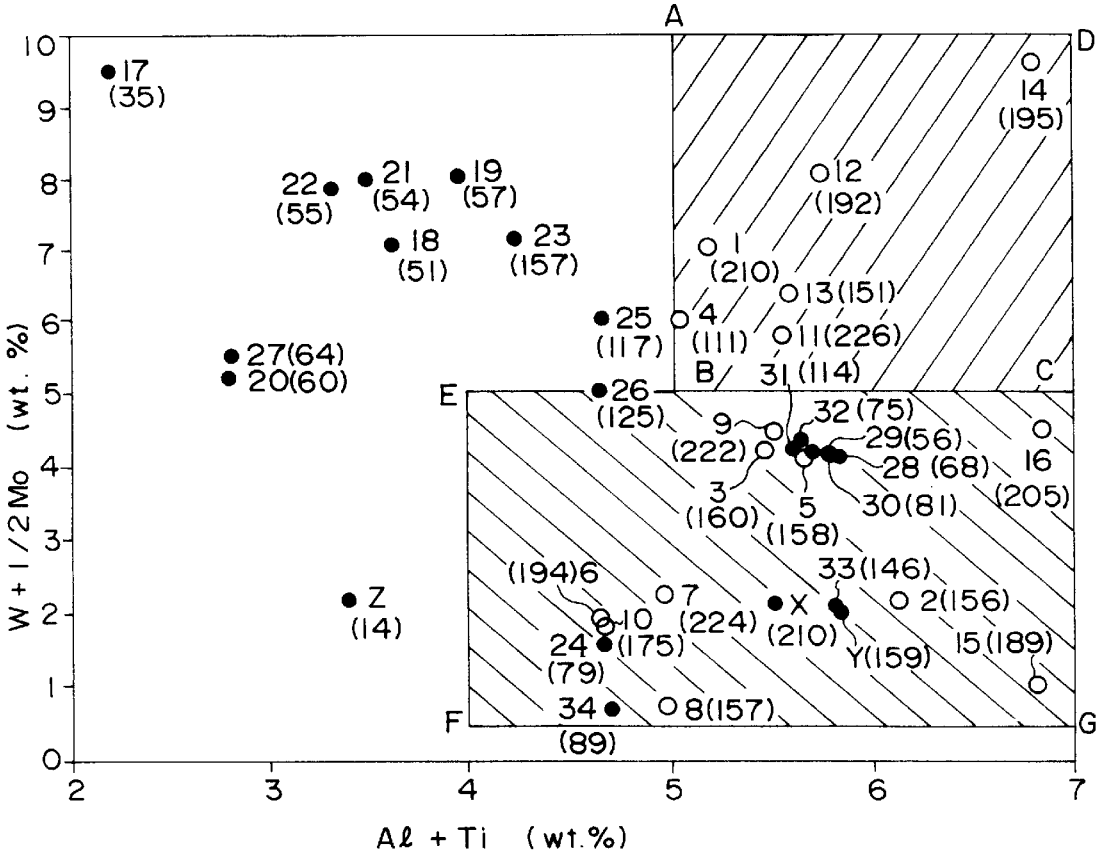
FIG. 1 is a diagram showing the scope of the alloy of the present invention and the test results with respect to creep rupture life.

The functions of elements in the alloy composition of the heat-resistant Ni-based alloy of the present invention will now be described together with the reasons for specifying the content (by weight) of the elements added thereto.

C forms a carbide which precipitates particularly in the crystal grain boundaries and in dendrite boundaries to strengthen the grain boundaries and the dendrite boundaries. When the C content is lower than 0.05%, the strengthening effect thereof is negligible. When it exceeds 0.25%, the ductility and creep strength of the alloy are lowered. It is especially preferable in the range of 0.09 to 0.23%.

The Cr content is specified to be 18 to 25% in the foregoing nickel-based nickel alloy (1) of the first type and 10 to 20% in the nickel-based nickel alloy (2) of the second type. Cr is an element capable of imparting an oxidation resistance and a corrosion resistance at high temperatures to the alloy. When the Cr content is lower than the above-specified lower limits, the effect thereof is poor. When it exceeds the above-specified upper limits, there is a possibility of forming the α phase when the alloy is used at a high temperature for a long period of time. Additionally stated, the nickel-based nickel alloy (1) is provided having particular regard to the corrosion resistance and oxidation resistance thereof, while the nickel-based nickel alloy (2) is provided having particular regard to the high-temperature strength thereof.

Co has a function of increasing the limit of solid solution (solid solution limit) of γ' phase-forming elements such as Ti and Al into the matrix at a high temperature. With the Al and Ti contents of the alloy according to the present invention, a Co content of at least 15.0% must be adopted. On the other hand, the Co content is specified to be at most 25.0% in order to avoid forming the α phase.

Ti is an element required for precipitation of the γ' phase to increase the high-temperature strength of the alloy. When the Ti content is lower than 1.0%, the desired strength cannot be secured. On the other hand, it is specified to be at most 5.0% because too much Ti spoils the ductility and weldability of the alloy.

Al also forms the γ' phase, like Ti, to increase the high-temperature strength of the alloy while contributing to impart to the alloy an oxidation resistance and a corrosion resistance at high temperatures. The Al content must be at least 1.0%, while it is specified to be at most 4.0% because too much addition of Al spoils the ductility and weldability of the alloy. The (Al+Ti) content is especially preferably in the range of 4.0 to 7.0%.

W and Mo have a function of solid solution strengthening and weak precipitation strengthening to contribute to imparting a high-temperature strength to the alloy. In order to secure the foregoing effect, the (W+½Mo) content must be at least 0.5%. Since too high an addition of these elements spoils the ductility of the alloy, the W content, the Mo content, and the (W+½Mo) content are specified to be at most 10%, at most 3.5%, and at most 10%, respectively.

Ta and Nb contribute to an improvement in high-temperature strength through solid solution strengthening and γ' phase precipitation strengthening. This effect is exhibited when the Ta content is at least 0.5% and when the Nb content is at least 0.2%. On the other hand, since too high an addition of these elements lowers the ductility of the alloy, the Ta content and the Nb content are specified to be at most 4.5% and at most 3.0%, respectively. The Ta content and the Nb content are especially preferable in the range of 1.0 to 4.2% and in the range of 0.5 to 1.5%, respectively.

Zr exhibits the effect of increasing the bonding strength in crystal grain boundaries to strengthen the grain boundaries. When the Zr content is lower than 0.005%, no improvement in creep strength can be observed. On the other hand, when it exceeds 0.10%, the weldability of the alloy is unfavorably lowered. Thus, it must be in the range of 0.005 to 0.10%, and is especially preferably in the range of 0.01 to 0.10%.

B increases the bonding strength in crystal grain boundaries to strengthen the grain boundaries. When the B content is lower than 0.001%, no improvement in creep strength can be observed. On the other hand, when it exceeds 0.01%, the weldability of the alloy is unfavorably lowered. Thus, the B content is specified to be in the range of 0.001 to 0.01%.

The reasons why limitations are made within the ranges (excluding the line A-B-E) surrounded by the lines in FIG. 1 are as follows. Al and Ti precipitate the γ' phase, i.e., $Ni_3$(Al, Ti), as a factor in strengthening the Ni-based alloy to increase the high-temperature strength thereof. Since too high an addition of these elements lowers the weldability and ductility of the alloy, however, the (Al+Ti) content is specified to be at most 7%. When it is too low, the effect of increasing the high-temperature strength of the alloy is decreased. Thus, it is specified to be at least 4% as shown in the same figure. Additionally stated, since the Cr content also exerts an influence on the high-temperature strength of the alloy, the lower limit of the (Al+Ti) content is specified, with taking also into account the Cr content, to be at least 4%, as shown in the same figure. W and Mo have a function of solid solution strengthening and carbide precipitation strengthening to exhibit the effect of increasing the high-temperature strength of the alloy. In order to secure this effect, the (W+½Mo) content must be at least 0.5%. On the other hand, since too much addition of these elements fosters precipitation of deleterious phases such as the σ phase to lower the ductility and strength of the alloy, the upper limit of the (W+½Mo) content is specified to be 10%.

In the (Al+Ti) and (W+½Mo) content ranges, when the (W+½Mo) content is in the range of from 5 to 10%, the (Al+Ti) content should be more than 5 to 7% and therefore (Al+Ti) and (W+½Mo) content on the line A-B is excluded. Further, when the (Al+Ti) content is in the range of from 4 to 5%, the (W+½Mo) content should be 0.5 to less than 5% and therefore (Al+Ti) and (W+½Mo) content on the line B-E is excluded. When the (Al+Ti) and (W+½Mo) contents are on these lines A-B and B-E, a satisfactory creep rupture life cannot be ensured without deteriorating the weldability as measured by a varestraint test.

The following specific Examples will illustrate the present invention in more detail.

EXAMPLE 1

Table 1 shows the chemical compositions (by wt. %) of representative alloys invented for the stationary vane of a gas turbine. On the other hand, Table 2 shows the chemical compositions of comparative alloys as conventional alloys. Each composition was melted in a high-frequency vacuum melting furnace to prepare 20 kg of an ingot. This sample was precision-cast as the master ingot according to a lost wax process, and then heat-treated at 1,160° C. for 4 hours, at 1,000° C. for 6 hours, and at 800° C. for 4 hours. Thereafter, it was machined into creep rupture test pieces of 6.25 mm ϕ×25 mm in parallel portion size, 5×60×100 mm varestraint test pieces, etc. Alloy Nos. 1 to 16 in Table 1 are alloys according to the present invention, while Alloy Nos. X, Y, Z, and 17 to 34 are comparative alloys. Additionally stated, the Alloys Nos. X and Y are examples of the aforementioned alloy of Japanese Patent Publication No. 6,968/1979, while the Alloy No. Z is an example of the aforementioned alloy of Japanese Patent Laid-Open No. 104,738/1989.

FIG. 1 shows the relationship between the (Al+Ti) content and the (W+½Mo) content for every sample as well as the creep rupture life under 20 kgf/mm$^2$ at 900° C. in (Δ) accompanying every sample No. Additionally stated, in FIG. 1, the alloys according to the present invention are indicated by the open symbol (○), while the comparative alloys are indicated by the solid symbol (●).

Alloys of the present invention with high (Al+Ti) and (W+½Mo) contents which are in the range surrounded by the lines connecting points A, B, C, and D (1, 4, 11, 12, 13, and 14) all exhibit a high strength, and Alloy No. 11 in particular exhibits an especially high strength. Alloys of the present invention with a low Cr content and with (Al+Ti) and (W+½Mo) contents which are in the range surrounded

TABLE 1

Alloys according to Present Invention

| | Chemical Composition/wt % | | | | | | | | | | | | Al + Ti | W + ½Mo | Creep Rupture Life 900° C. × 20 kg/ |
|---|---|---|---|---|---|---|---|---|---|---|---|---|---|---|---|
| | C | Cr | Co | Al | Ti | W | Mo | Ta | Nb | Zr | B | Ni | (wt %) | (wt %) | mm$^2$ (h) |
| 1 | 0.10 | 18.30 | 20.50 | 2.50 | 2.66 | 7.00 | — | 0.50 | 0.50 | 0.09 | 0.007 | Bal. | 5.16 | 7.0 | 209.6 |
| 2 | 0.18 | 19.90 | 19.70 | 1.70 | 4.44 | 2.20 | — | 1.50 | 1.10 | 0.10 | 0.007 | Bal. | 6.14 | 2.2 | 155.6 |
| 3 | 0.17 | 19.80 | 19.70 | 1.70 | 3.74 | 4.20 | — | 1.40 | 1.10 | 0.03 | 0.003 | Bal. | 5.44 | 4.2 | 160.4 |
| 4 | 0.15 | 22.00 | 15.70 | 1.50 | 3.53 | 6.00 | — | 3.10 | 0.50 | 0.03 | 0.009 | Bal. | 5.03 | 6.0 | 111.3 |
| 5 | 0.15 | 19.86 | 18.47 | 1.93 | 3.71 | 4.14 | — | 1.51 | 0.96 | 0.03 | 0.003 | Bal. | 5.64 | 4.14 | 158.2 |
| 6 | 0.11 | 18.23 | 19.07 | 2.50 | 2.15 | 1.65 | 0.56 | 4.00 | 0.30 | 0.10 | 0.008 | Bal. | 4.65 | 1.93 | 194.2 |
| 7 | 0.09 | 18.23 | 18.58 | 2.58 | 2.38 | 1.97 | 0.57 | 3.76 | 0.30 | 0.06 | 0.006 | Bal. | 4.96 | 2.26 | 224.4 |
| 8 | 0.12 | 17.93 | 19.84 | 2.53 | 2.44 | 0.52 | 0.51 | 2.98 | 0.50 | 0.10 | 0.006 | Bal. | 4.97 | 0.78 | 156.8 |
| 9 | 0.16 | 18.25 | 20.14 | 1.91 | 3.58 | 4.46 | — | 1.50 | 0.93 | 0.04 | 0.006 | Bal. | 5.49 | 4.46 | 202.8 |
| 10 | 0.14 | 18.34 | 19.14 | 2.54 | 2.13 | 1.57 | 0.56 | 4.13 | 0.30 | 0.09 | 0.010 | Bal. | 4.67 | 1.85 | 174.7 |
| 11 | 0.18 | 18.76 | 19.50 | 1.95 | 3.58 | 5.77 | — | 1.53 | 0.92 | 0.04 | 0.006 | Bal. | 5.53 | 5.77 | 225.6 |
| 12 | 0.16 | 20.25 | 15.06 | 1.93 | 3.79 | 8.04 | — | 1.45 | 0.91 | 0.03 | 0.006 | Bal. | 5.72 | 8.04 | 192.0 |
| 13 | 0.18 | 19.25 | 19.47 | 1.96 | 3.61 | 6.35 | — | 1.40 | 0.95 | 0.03 | 0.007 | Bal. | 5.57 | 6.35 | 151.4 |
| 14 | 0.18 | 21.40 | 19.30 | 3.15 | 3.65 | 8.02 | 3.08 | 1.41 | 0.93 | 0.06 | 0.005 | Bal. | 6.80 | 9.56 | 195.0 |
| 15 | 0.15 | 19.10 | 18.90 | 3.20 | 3.63 | 0.72 | 0.76 | 1.63 | 0.73 | 0.07 | 0.007 | Bal. | 6.83 | 1.10 | 189.0 |
| 16 | 0.19 | 19.20 | 18.80 | 3.26 | 3.60 | 4.31 | 0.38 | 1.81 | 0.66 | 0.06 | 0.005 | Bal. | 6.86 | 4.50 | 205.0 |

TABLE 2

Comparative Alloys

| | Chemical Composition/wt % | | | | | | | | | | | | Al + Ti | W + ½Mo | Creep Rupture Life 900° C. × 20 kg/ |
|---|---|---|---|---|---|---|---|---|---|---|---|---|---|---|---|
| | C | Cr | Co | Al | Ti | W | Mo | Ta | Nb | Zr | B | Ni | (wt %) | (wt %) | mm$^2$ (h) |
| X | 0.14 | 22.40 | 18.9 | 1.86 | 3.64 | 2.18 | — | 1.46 | 0.95 | 0.09 | 0.009 | Bal. | 5.5 | 2.18 | 209.8 |
| Y | 0.14 | 22.33 | 18.84 | 1.92 | 3.91 | 2.08 | — | 1.48 | 0.98 | 0.08 | 0.009 | Bal. | 5.83 | 2.08 | 158.5 |
| Z | 0.10 | 23.00 | 19.50 | 1.16 | 2.25 | 2.16 | — | 1.16 | 0.71 | 0.03 | 0.008 | Bal. | 3.41 | 2.16 | 14.0 |
| 17 | 0.09 | 21.40 | 14.70 | 0.95 | 1.24 | 7.93 | 3.17 | 3.85 | ’ | 0.11 | 0.009 | Bal. | 2.19 | 9.52 | 34.8 |
| 18 | 0.09 | 21.60 | 14.80 | 0.98 | 2.64 | 5.94 | 2.26 | 2.84 | — | 0.11 | 0.010 | Bal. | 3.62 | 7.07 | 50.8 |
| 19 | 0.09 | 21.70 | 14.90 | 2.24 | 1.71 | 5.99 | 4.11 | 1.92 | — | 0.11 | 0.010 | Bal. | 3.95 | 8.05 | 57.3 |
| 20 | 0.09 | 21.80 | 14.9 | 1.52 | 1.27 | 4.55 | 1.29 | 5.76 | — | 0.11 | 0.009 | Bal. | 2.79 | 5.20 | 60.4 |
| 21 | 0.09 | 21.70 | 14.80 | 1.75 | 1.73 | 5.94 | 4.07 | 2.45 | — | 0.11 | 0.010 | Bal. | 3.48 | 7.98 | 54.3 |
| 22 | 0.09 | 21.80 | 14.90 | 1.71 | 1.60 | 5.82 | 4.02 | 1.94 | 0.50 | 0.11 | 0.010 | Bal. | 3.31 | 7.83 | 54.9 |
| 23 | 0.06 | 21.00 | 15.10 | 2.54 | 1.69 | 7.12 | — | 3.93 | — | 0.11 | 0.010 | Bal. | 4.23 | 7.12 | 157.2 |
| 24 | 0.06 | 22.70 | 14.80 | 1.47 | 3.20 | — | 3.15 | 2.93 | — | 0.11 | 0.009 | Bal. | 4.67 | 1.58 | 79.0 |
| 25 | 0.14 | 23.30 | 15.40 | 1.47 | 3.18 | 6.01 | — | 2.90 | — | 0.10 | 0.009 | Bal. | 4.65 | 6.01 | 117.4 |
| 26 | 0.10 | 22.10 | 22.20 | 2.70 | 1.93 | 5.00 | — | 2.10 | — | 0.10 | 0.008 | Bal. | 4.63 | 5.00 | 125.1 |
| 27 | 0.11 | 20.00 | 25.20 | 1.80 | 1.00 | 5.00 | 1.00 | 5.20 | — | 0.10 | 0.008 | Bal. | 2.80 | 5.5 | 64.0 |
| 28 | 0.21 | 21.86 | 14.58 | 2.01 | 3.81 | 4.14 | — | 1.43 | 0.99 | 0.03 | 0.004 | Bal. | 5.82 | 4.14 | 67.5 |
| 29 | 0.29 | 22.05 | 14.65 | 1.98 | 3.80 | 4.18 | — | 1.47 | 0.99 | 0.04 | 0.004 | Bal. | 5.78 | 4.18 | 55.9 |
| 30 | 0.30 | 21.92 | 14.56 | 1.95 | 3.73 | 4.20 | — | 1.50 | 0.99 | 0.11 | 0.003 | Bal. | 5.68 | 4.20 | 80.7 |
| 31 | 0.09 | 21.82 | 18.54 | 1.93 | 3.67 | 4.23 | — | 1.39 | 0.95 | 0.03 | 0.004 | Bal. | 5.60 | 4.23 | 113.5 |
| 32 | 0.31 | 21.90 | 18.52 | 1.94 | 3.69 | 4.38 | — | 1.58 | 0.98 | 0.04 | 0.004 | Bal. | 5.63 | 4.38 | 95.2 |
| 33 | 0.15 | 22.35 | 18.73 | 1.94 | 3.87 | 2.14 | — | 1.51 | 0.98 | 0.03 | 0.007 | Bal. | 5.81 | 2.14 | 145.6 |
| 34 | 0.11 | 18.41 | 19.99 | 3.52 | 1.18 | 0.48 | 0.48 | 2.99 | — | 0.11 | 0.006 | Bal. | 4.70 | 0.72 | 88.5 |

by the lines connecting points E, F, G and C (2, 3, 5, 6, 7, 8, 9, 10, 15 and 16) exhibit an especially high strength.

Figure 2:
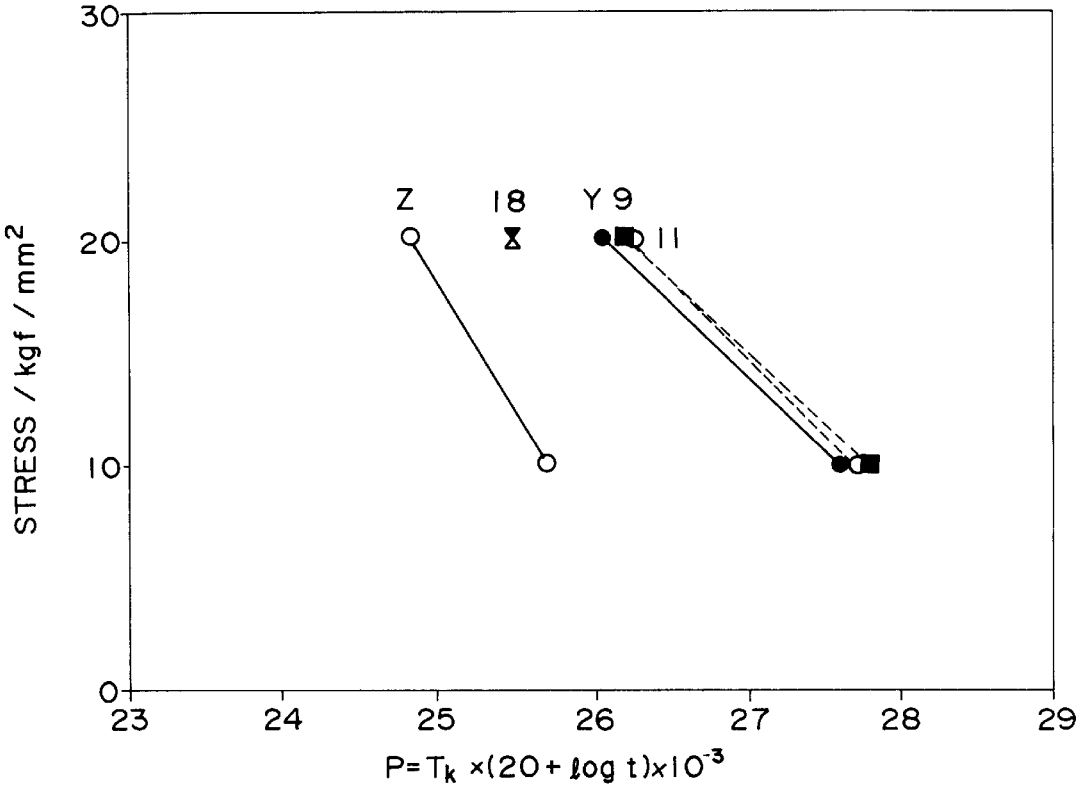
FIG. 2 is a diagram showing a comparison of alloys tested for creep rupture strength.

FIG. 2 shows a comparison of Alloys Nos. 9 and 11 of the present invention in Table 1 with the Comparative Alloys Nos. Y, Z, and 18 in Table 2 with respect to creep rupture strength under 20 kgf/mm$^2$ at 900° C. and under 10 kgf/mm$^2$ at 980° C. The abscissa represents the Larson-Miller parameter: $P=T_k\ (20+\log t)\times 10^{-3}$, wherein $T_k$: test temperature (° K.) and t: rupture life (hr). The test results at 900° C. and 980° C. correspond to the points of 20 kgf/mm$^2$ and 10 kgf/mm$^2$, respectively, in terms of stress represented by the ordinate. It is demonstrated that the higher the parameter P in the abscissa, the higher the strength. Alloys Nos. 9 and 11 of the present invention are higher in Larson-Miller parameter under the same test stress than the Comparative Alloy Nos. Y, Z, and 18. This is the effect of increasing the (Al+Ti) content and the (W+½Mo) content while decreasing the Cr content (No. 11). On the other hand, Comparative Alloy No. Y, which was slightly higher in (Al+Ti) content than Alloy No. 9 and high also in Cr content, Comparative Alloy No. 18 which was low in (Al+Ti) content but high in (W+½Mo) content, Comparative Alloy No. Z which was low in both of (Al+Ti) content and (W+½Mo) content, etc. are lower in Larson-Miller parameter under the same test stress than the alloys of the present invention.

Figure 6A:
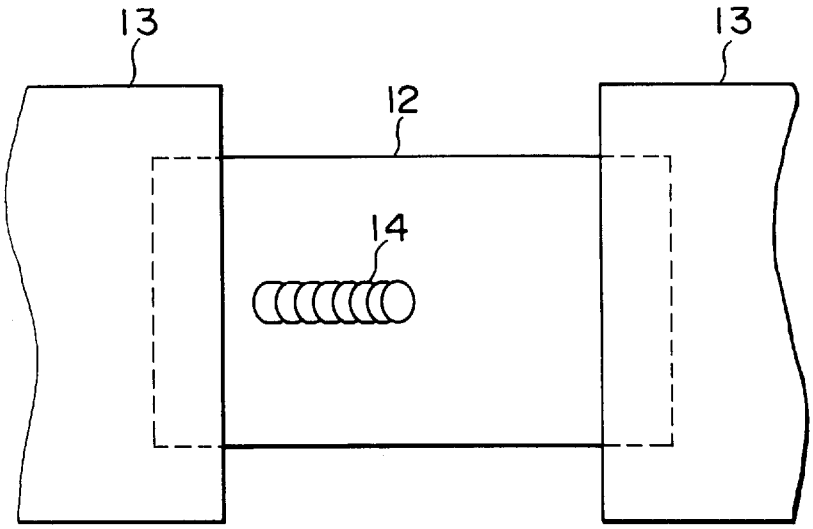
FIGS. 6A and 6B are illustrations of the essentials of the varestraint test carried out for the evaluation of weldabilities of alloys according to the present invention and comparative alloys.
Figure 6B:
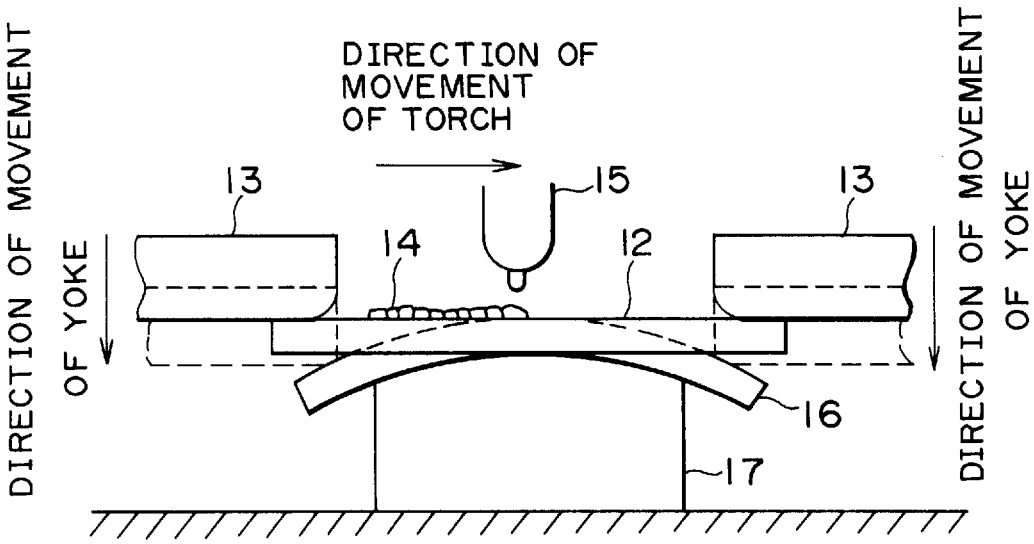

The weldability was evaluated according to a varestraint test, as shown in FIGS. 6A and 6B. In the figures, reference numerals are as follows: 12: varestraint test piece (before application of flexural stress), 13: yoke, 14: bead, 15: welding torch, 16: varestraint test piece (after application of flexural stress), and 17: bending block.

Figure 3:
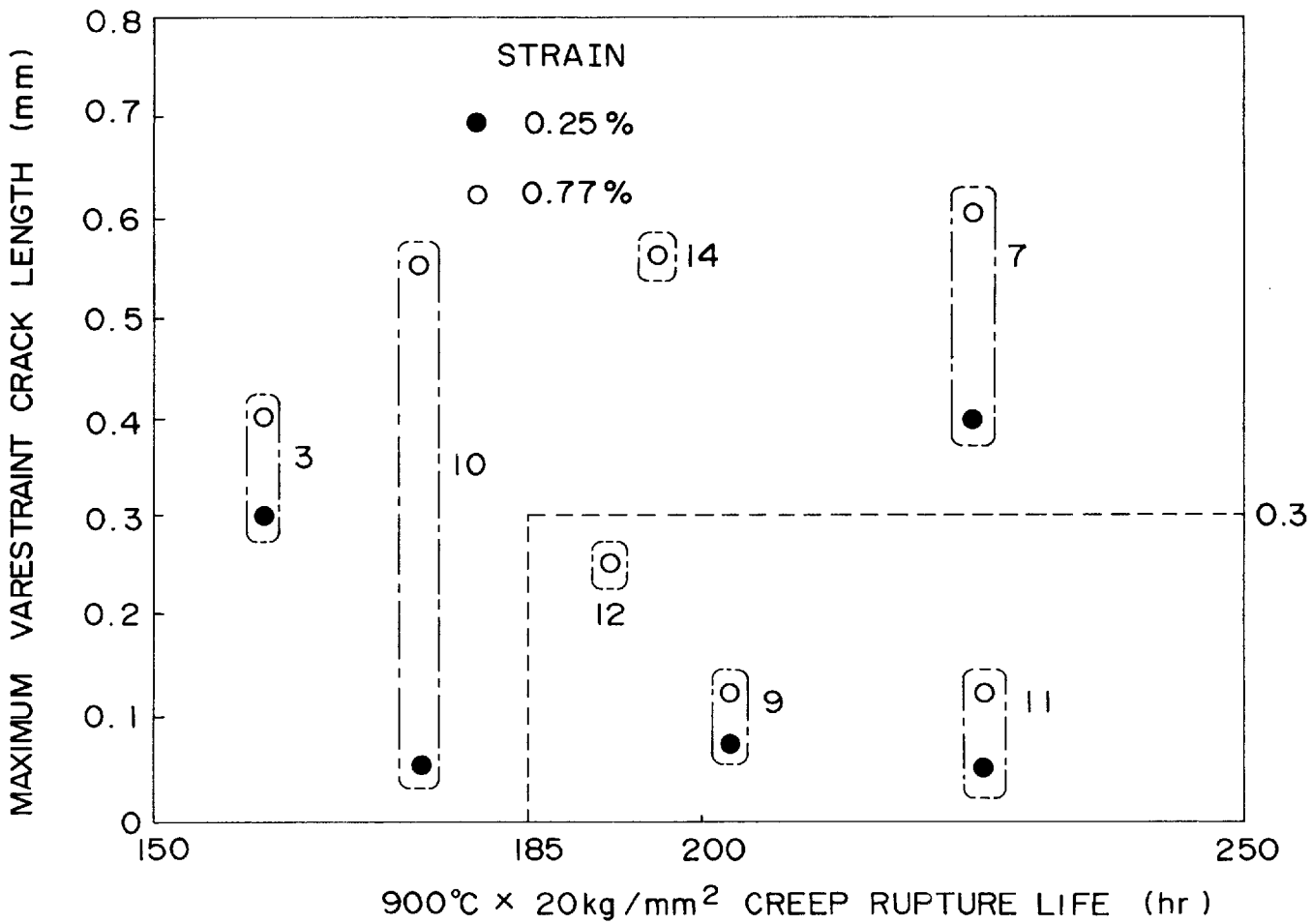
FIG. 3 is a diagram showing the relationship between the maximum varestraint crack length and the creep rupture life.

Specifically, test pieces were TIG-welded to each other under welding conditions involving a welding current of 100 A, a welding voltage of 12 V, and a welding speed of 1.67 mm/sec, and then loaded with a total strain of 0.25% or 0.77%. The resulting maximum crack length as a yardstick of the zone turned brittle when the welding was measured. FIG. 3 shows the relationship between the maximum crack length and the creep rupture life (900° C.×20 kgf/mm$^2$). The ordinate in the same figure demonstrates that the smaller the maximum crack length, the better the weldability. Accordingly, as the point is located at the further right side and at the lower side, the alloy is higher in high-temperature strength and better in weldability, respectively. Alloy Nos. 3, 7, 9, 10, 11, 12, and 14 with a Zr content of at most 0.1% and a B content of at most 0.01 according to the present invention all have a small maximum crack length in the varestraint test. Alloy Nos. 9, 11, and 12 in particular showed a maximum crack length of at most 0.3 mm as the target and a creep rupture life of at least 185 hours, and hence have excellent properties. On the other hand, Comparative Alloys Nos. X, Y, 23, 25, 26, 31, and 33 all showed a maximum crack length in the varestraint test of at least 0.8 mm to miss the target, though they showed a creep rupture life of at least 110 hours.

Figure 7:
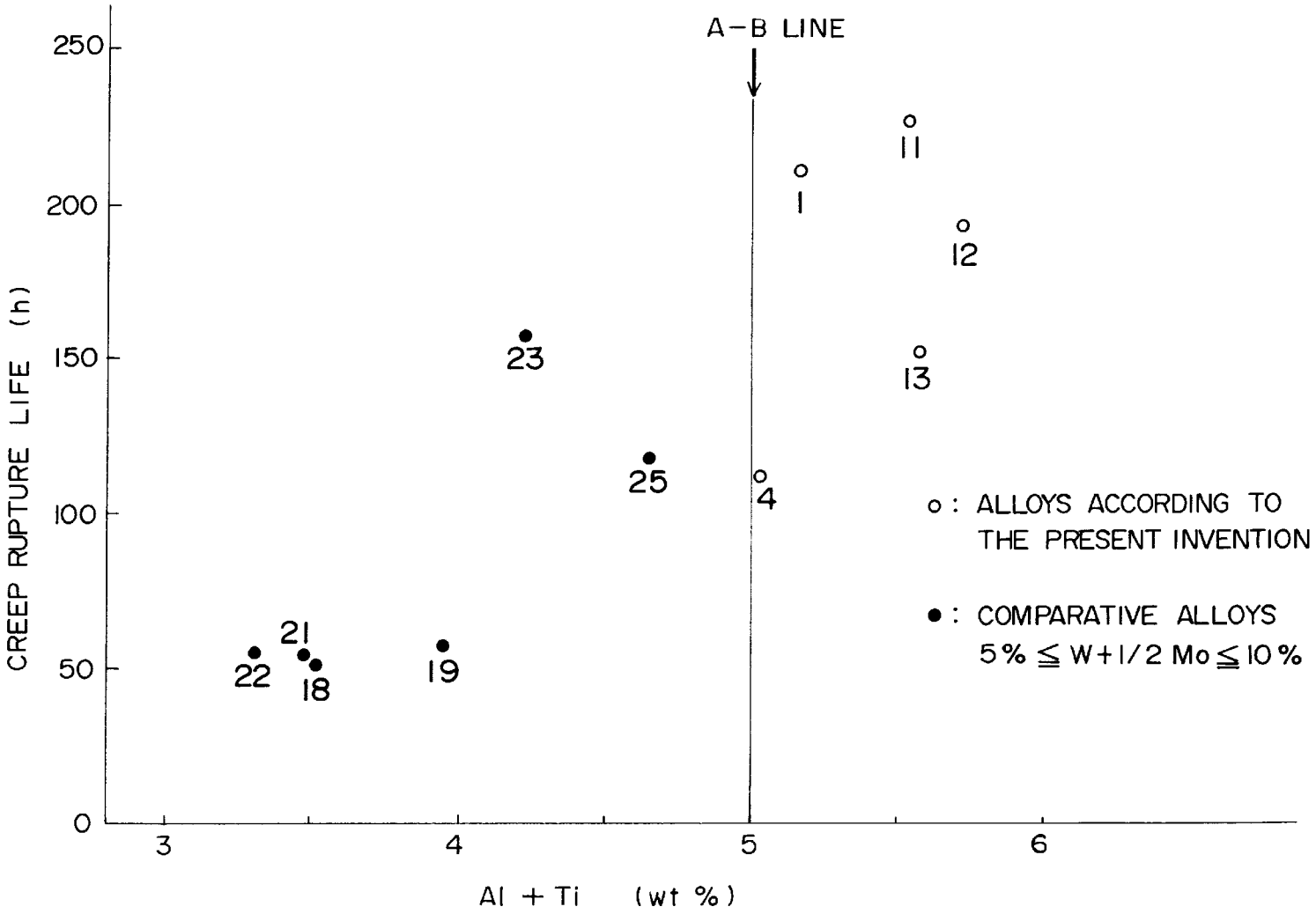
FIG. 7 is a diagram showing the reason why the (Al+Ti) content and the (W+½Mo) content on the line A-B are excluded from the range surrounded by the lines connecting points A, B, C and D in FIG. 1

FIG. 7 shows the relationship between the creep rupture life and the (Al+Ti) content including the line A-B (Al+Ti=5%, 5%≦W+½Mo≦10%). As apparent from FIG. 7, within a W+½Mo content range of from 5% to 10%, the creep rupture life becomes longer with an increase in Al+Ti content and the inventive alloys on the whole have a longer creep rupture life than the creep rupture life of the comparative alloys. For example, Alloy No. 4 of the present invention having a (W+½Mo) content of 5.03%, which was very slightly higher than 5%, showed a creep fracture life of 111 hours. On the other hand, in the case of Comparative Alloy No. 25, which was outside the present invention with respect to the content of Nb and (Al+Ti), the (Al+Ti) content of 4.6% was slightly below 5% and showed a creep rupture life of 117 hours which was almost the same level as that of Alloy No. 4. However, this comparative alloy failed to suppress the maximum crack length in the varestraint test to the intended level, i.e., not longer than 0.8 mm. From these results, it is considered that criticality exists on the line A-B [(Al+Ti) content=5%] and, therefore, this line is excluded from the content range of the present invention.

Figure 8:
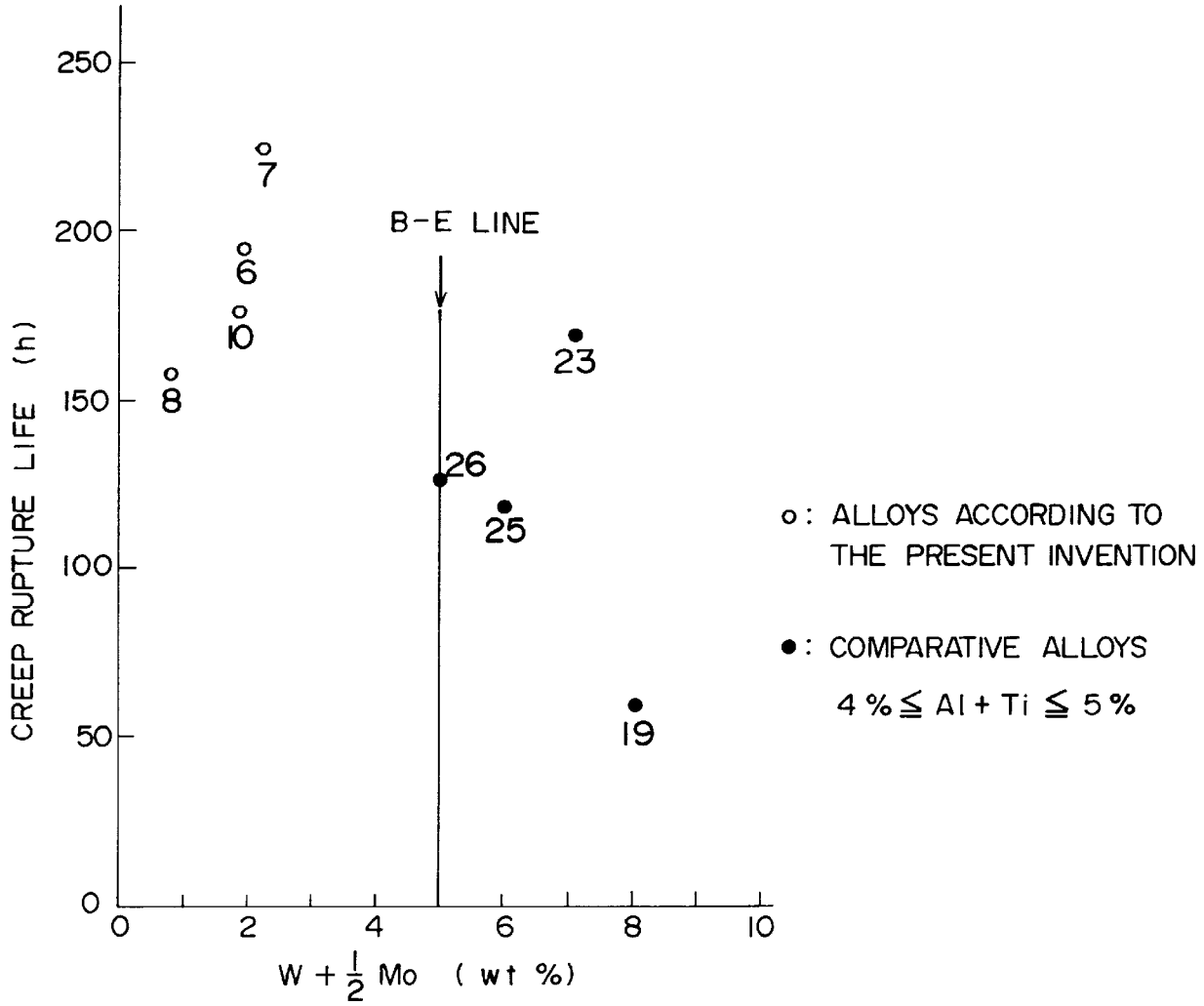
FIG. 8 is a diagram showing the reason why the (Al+Ti) content and the (W+½Mo) content on the lines A-B-E are excluded from the range surrounded by the line connecting points A, B, E, F, G and D in FIG. 1.

FIG. 8 shows the relationship between the creep rupture life and the (W+½Mo) content including the line B-E (W+½Mo=5%, 4%≦Al+Ti≦5%). As apparent from FIG. 8, within the (Al+Ti) content range of not more than 5%, the creep rupture life becomes longer with a decrease in W+½Mo content. Comparative Alloy No. 26 with a (W+½Mo) of 5% showed a relatively long rupture life, but the maximum crack length in the varestraint test exceeded 0.8 mm to miss the target, as described above. Therefore, the line B-E was excluded from the content range of the present invention. Further, Comparative Alloy No. 23 in FIGS. 7 and 8 showed a relatively long rupture life of 157 hours. However, this comparative alloy includes Zr in an amount of 0.11%, exceeding the Zr content range of this invention, and, as shown in FIG. 1, the (Al+Ti) content and the (W+½Mo) content were outside the range of the present invention. Therefore, this comparative alloy showed a maximum crack length in the varestraint test of at least 0.8 mm to miss the target. Therefore, although Comparative Alloy 23 had a relatively long rupture life, this alloy was on the whole far inferior to the alloys of the present invention.

As is apparent from the foregoing results, a good weldability and a high creep strength can be secured either if the relationship between the (Al+Ti) content and the (W+½Mo) content are specified to be in the range A-B-C-D, excluding the line A-B, even though the Zr content and the B content are lowered, or if the relationship between the (Al+Ti) content and the (W+½Mo) content are specified to be in the range A-B-E-F-G-D, excluding the line A-B-E, with a decrease in Cr content. Such effects cannot be achieved by any alloy outside the foregoing compositional range, even if it has a composition very close to the alloy of the present invention, as referred to Comparative alloys 23, 25, 26, etc.

EXAMPLE 2

Figure 4:
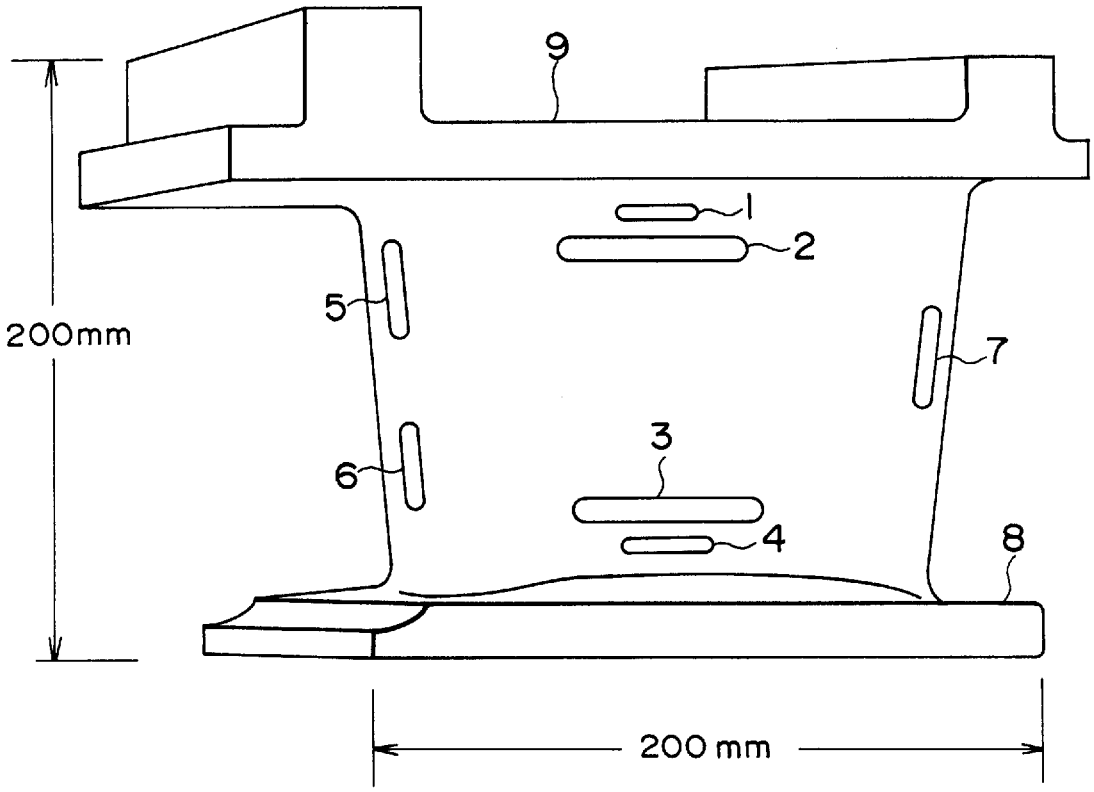
FIG. 4 is a perspective view of the stationary vane of a gas turbine produced using the alloy of the present invention and subjected to a weldability test.
Figure 5:
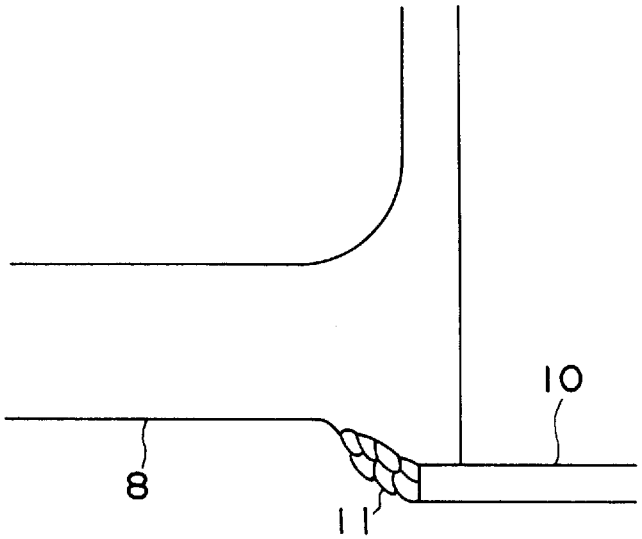
FIG. 5 is an illustration of the welded portion in the weldability test.

Alloy No. 11 of Example 1, as shown in Table 1, was used to produce the stationary vane of a gas turbine as shown in FIG. 4 according to the lost wax precision-casting process. The resulting product was subjected to a solution heat treatment at 1,160° C. for 4 hours, and then subjected to a weldability test. The stationary vane had a profile portion width of about 200 mm and a height of about 200 mm, and was a cast article having a hollow structure provided with an internal air path for cooling the same. As shown in FIG. 4, build-up welding, or padding, was carried out in ventral places 1, 2, 3, and 4 of a vane portion, places 5 and 6 of the leading edge, and a place 7 of the trailing edge. Reference numeral 9 represents an outer shroud. As shown in FIG. 5, the shroud portion 8 (Alloy No. 11 of the present invention) of the inner shroud 8 was welded with a cover plate 10 (Hastelloy X alloy) with a fillet welding of Hastelloy W alloy 11 according to the TIG welding method. After the welding, a visual inspection and a fluorescence penetrant inspection, an observation of the microstructure of the cross section at the position as shown in FIG. 5, etc. were carried out and no cracks were found in any place. Additionally stated, substantially the same stationary vane of a gas turbine as described above was produced using Comparative Alloy No. Y (Japanese Patent Publication No. 6,968/1979), and subjected to a weldability test. As a result, many cracks were found by a fluorescence penetrant inspection, while cracks of about 1 mm in length were found by an observation of the microstructure of the cross section.

As described hereinbefore, according to the present invention, a heat-resistant Ni-based alloy can be obtained, which has a higher high-temperature strength and a better weldability than conventional heat-resistant Ni-based alloys. This heat-resistant Ni-based alloy is especially suitable as a material for the stationary vane of a gas turbine required to be reliable in keeping with an increase in the service temperature of the gas turbine.

What is claimed is:

1. A heat-resistant nickel-based alloy having excellent welding properties, said nickel-based alloy consisting essentially of, in terms of wt. %, 0.05 to 0.25% of C, 18 to 25% of Cr, 15 to 25% of Co, at least one selected from the group consisting of up to 3.5% of Mo and 5 to 10% of W, with W+½Mo being 5 to 10%, 1.0 to 5.0% of Ti, 1.0 to 4.0% of Al, 0.5 to 4.5% of Ta, 0.2 to 3.0% of Nb, 0.005 to 0.10% of Zr, 0.001 to 0.01% of B and the balance being Ni and unavoidable impurities, wherein the (Al+Ti) content and the (W+½Mo) content are within the range surrounded by the lines connecting point A (Al+Ti: 5%, W+½Mo: 10%), point B (Al+Ti: 5%, W+½Mo: 5%), point C (Al+Ti: 7%, W+½Mo: 5%), and point D (Al+Ti: 7%, W+½Mo: 10%), excluding the line A-B in FIG. 1, said alloy having a creep rupture life of at least 110 hours as measured under a stress of 20 kgf/mm$^2$ at 900° C.

2. The heat-resistant nickel-based alloy of claim 1, wherein Mo is contained in the alloy.

3. The heat-resistant nickel-based alloy of claim 1, wherein the alloy contains 0.09–0.23% C, 1.0–4.2% Ta, 0.5–1.5% Nb and 0.01–0.10% Zr.

4. The heat-resistant nickel-based alloy of claim 1, wherein the Al+Ti content is from 5.03 to 7 wt. %.

5. A heat-resistant nickel-based alloy having excellent welding properties, said nickel-based alloy consisting essentially of, in terms of wt. %, 0.05 to 0.25% of C., 10 to 20% of Cr, 15 to 25% of Co, at least one selected from the group consisting of up to 3.5% of Mo and 0.5 to 10% of W, with W+½Mo being 0.5 to 10%, 1.0 to 5.0% of Ti, 1.0 to 4.0% of Al, 0.05 to 4.5% of Ta, 0.2 to 3.0% of Nb, 0.005 to 0.10% of Zr, 0.001 to 0.01% of B and the balance being Ni and unavoidable impurities, wherein the (Al+Ti) content and the (W+½Mo) content are within the range surrounded by the lines connecting point A (Al+Ti: 5%, W+½Mo: 10%), point B (Al+Ti: 5%, W+½Mo: 5%), point E (Al+Ti: 4%, W+½Mo: 5%), point F (Al+Ti: 4%, W+½Mo: 0.5%), point G (Al+Ti: 7%, W+½Mo: 0.5%), and point D (Al+Ti: 7%, W+½Mo: 10%), excluding the line A-B-E in FIG. 1, said alloy having a creep rupture life of at least 110 hours as measured under a stress of 20 kgf/mm$^2$ at 900° C.

6. The heat-resistant nickel-based alloy of claim 5, wherein Mo is contained in the alloy.

7. The heat-resistant nickel-based alloy of claim 5, wherein the alloy contains 0.09–0.23% C, 1.0–4.2% Ta, 0.5–1.5% Nb and 0.01–0.10% Zr.

8. The heat-resistant nickel-based alloy of claim 5, wherein the Al+Ti content is from 5.03 to 7 wt. %.

* * * * *